US010588371B2

(12) United States Patent
Grant-Drew

(10) Patent No.: US 10,588,371 B2
(45) Date of Patent: Mar. 17, 2020

(54) SAFETY LIGHT APPARATUS FOR HEADWEAR

(71) Applicant: Benjamin Robert Grant-Drew, Brisbane (AU)

(72) Inventor: Benjamin Robert Grant-Drew, Brisbane (AU)

( * ) Notice: Subject to any disclaimer, the term of this patent is extended or adjusted under 35 U.S.C. 154(b) by 0 days.

(21) Appl. No.: 15/791,765

(22) Filed: Oct. 24, 2017

(65) Prior Publication Data

US 2018/0110279 A1 Apr. 26, 2018

(30) Foreign Application Priority Data

Oct. 25, 2016 (AU) ..... 2016904340

(51) Int. Cl.

| | |
|---|---|
| ***A42B 3/04*** | (2006.01) |
| ***F21L 4/08*** | (2006.01) |
| ***F21V 3/02*** | (2006.01) |
| ***F21V 15/01*** | (2006.01) |
| ***F21V 19/00*** | (2006.01) |
| ***F21V 23/04*** | (2006.01) |
| *F21Y 115/10* | (2016.01) |

(52) U.S. Cl.

CPC ..... *A42B 3/044* (2013.01); *F21L 4/08* (2013.01); *F21V 3/02* (2013.01); *F21V 15/01* (2013.01); *F21V 19/0015* (2013.01); *F21V 23/0414* (2013.01); *F21Y 2115/10* (2016.08)

(58) Field of Classification Search

CPC ... A42B 3/044; F21L 4/08; F21V 3/02; F21V 15/01; F21V 19/0015; F21V 23/0414

See application file for complete search history.

(56) References Cited

U.S. PATENT DOCUMENTS

| | | | | |
|---|---|---|---|---|
| 5,357,409 | A * | 10/1994 | Glatt | A42B 3/044 362/105 |
| 6,007,213 | A * | 12/1999 | Baumgartner | A42B 3/044 362/105 |
| 7,128,434 | B1 * | 10/2006 | Nally | A42B 3/044 362/105 |
| 9,265,295 | B2 * | 2/2016 | Boulan | A42B 3/044 |
| 2011/0289658 | A1 * | 12/2011 | Knoepfli | A42B 3/0433 2/410 |
| 2013/0176714 | A1 * | 7/2013 | Leegate | F21V 23/0414 362/184 |

FOREIGN PATENT DOCUMENTS

| | | | | |
|---|---|---|---|---|
| GB | 2410886 | A * | 8/2005 | A42B 3/044 |

* cited by examiner

*Primary Examiner* — Anabel Ton

(74) *Attorney, Agent, or Firm* — Randall Danskin P.S.

(57) ABSTRACT

The present invention relates to a light apparatus for headwear including an at least partially hollow, elongate housing for mounting to the headwear, at least one light located inside the elongate housing that is visible from the outside of the elongate housing, and at least one battery for powering the at least one light, such that when the light apparatus is mounted to the headwear, an orientation of the headwear can be determined.

17 Claims, 9 Drawing Sheets

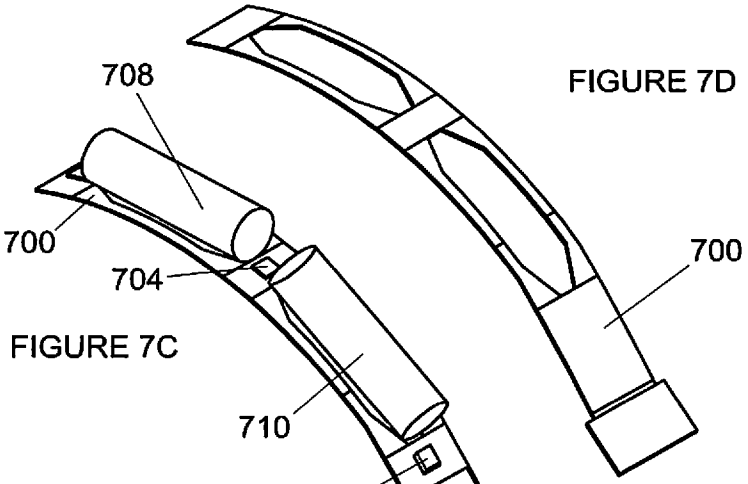
FIGURE 7D
FIGURE 7C
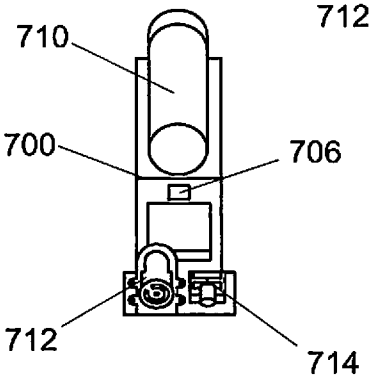
FIGURE 7E
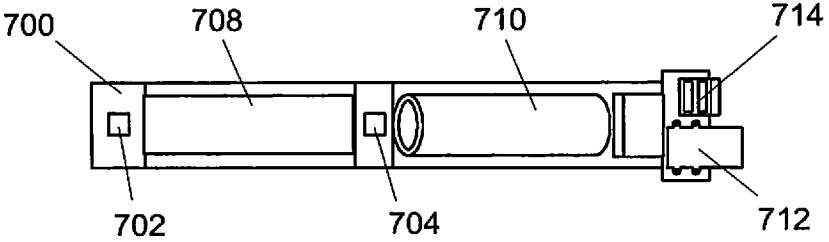
FIGURE 7A
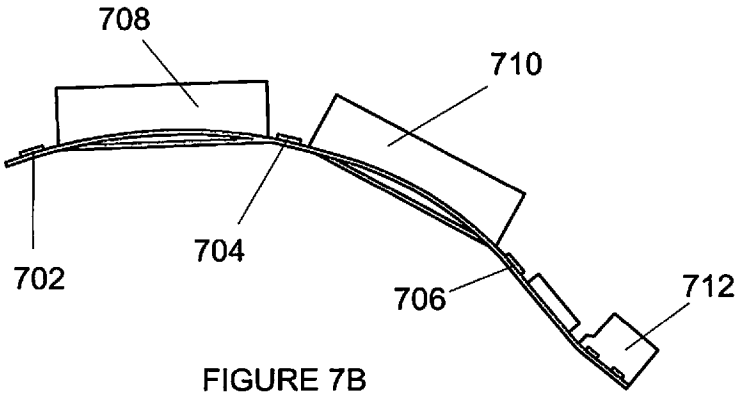
FIGURE 7B

SAFETY LIGHT APPARATUS FOR HEADWEAR

TECHNICAL FIELD

The present invention relates to a safety light for headwear and more particularly, to a safety light for hardhats and/or helmets.

BACKGROUND ART

Presently, people working in construction, mining or other high risk environments where the ability to establish where other workers are positioned is highly important, wear high visibility (also known as 'hi vis') clothing in order to increase visibility, and prevent accidents and/or injuries. Typically, such high visibility clothing is made in fluorescent colours and/or includes portions of reflective material which reflect light when light is shone on the material.

One problem with current high visibility clothing such as those described above is that it is difficult to be seen at night or in dark environments, for example underground, when no light source is present.

It will be clearly understood that, if a prior art publication is referred to herein, this reference does not constitute an admission that the publication forms part of the common general knowledge in the art in Australia or in any other country.

SUMMARY OF INVENTION

The present invention is directed to safety light apparatus for headwear, which may at least partially overcome at least one of the abovementioned disadvantages or provide the consumer with a useful or commercial choice.

With the foregoing in view, the present invention in one form, resides broadly in a light apparatus for headwear including:

an at least partially hollow, elongate housing for mounting to the headwear, at least one light located inside the elongate housing that is visible from the outside of the elongate housing, and at least one battery for powering the at least one light, such that when the light apparatus is mounted to the headwear, an orientation of the headwear can be determined.

Advantageously, a user wearing the lighting apparatus will be visible from a distance. Further, a third party will preferably be able to establish not only where the wearer is but also the attitude of the wearer. This may be particularly important for notification purposes or to indicate that the wearer has received a notification for example.

The headwear may be any one of a hardhat, safety helmet, Fire Brigade helmet, jockey helmet, bicycle helmet, motorbike, or the like.

The elongate housing may be made from any suitable material which allows the at least one light to be visible from the outside of the elongate housing. In some embodiments, the housing may be made from a transparent or translucent, or at least partially transparent or translucent, material. In some embodiments, the elongate housing may be made from an opaque material. The housing may be provided with a surface finish or layer that allows light to exit the housing through the walls but obscures the internal components of the housing.

In the embodiments wherein the elongate housing is made from an opaque material, the elongate housing or a portion of the elongate housing may be perforated to allow the at least one light to be visible from the outside of the elongate housing.

Alternatively, in the embodiments wherein the elongate housing is made from a transparent or translucent, or partially transparent or translucent material, the elongate housing may fully surround, cover or enclose the at least one light. The housing is preferably sealed or sealable against debris or detritus and/or liquids. Advantageously, the elongate housing protects the at least one light from debris or detritus which may damage the at least one light and/or prevent the at least one light from being visible from the outside of the elongate housing. A skilled person, however, would also understand that a housing made from a transparent or translucent, or partially transparent or translucent, material may also be perforated in order to increase visibility of the at least one light from the outside of the elongate housing.

In some embodiments, the elongate housing may have a substantially rectangular or trapezoidal cross-sectional shape. However, a person skilled in the art would understand that the cross-section of the elongate housing may be any size or shape suitable for housing components such as the at least one light and at least one battery.

In some embodiments, the shape of one end, e.g. a forward end, of the elongate housing may be different from the shape or configuration or colour of the other end, e.g. a rear end, of the elongate housing. For example, one end of the elongate body may taper towards the other end; or, a side profile of one end of the elongate housing may be a different shape in comparison to the other end of the elongate housing. Providing visually distinguishable sides and/or ends of the housing may allow an observer to distinguish which direction a user is facing from a distance. This may be especially advantageous, in the instance when an object is being moved in a particular direction towards a person wearing the light apparatus, an observer would be able to determine if the wearer is facing away or towards the object.

In some embodiments, the elongate housing may be mounted to the headwear such that one end of the elongate housing is located higher on the headwear relative to the other end. In some embodiments, the elongate housing may include one or more decorative features, for example, spikes.

The elongate housing may include a pair of side walls and an upper wall for connecting the pair of side walls together. The elongate housing may further include a rear end wall and a front end wall for capping the ends of the elongate housing. Each of the rear end wall and front end wall may extend between an inner surface of one side wall and an inner surface of the other side wall substantially in a transverse direction to the length of the elongate member. The pair of side walls, upper wall, rear end wall and front end wall may define a cavity for locating one or more electrical components, The side walls, rear end wall and front end wall may together define a lower edge of the elongate housing for locating the housing relative to the headwear. The lower edge may include a housing attachment means in the form of an inwardly extending lip that extends around the lower edge of the elongate housing for mounting the elongate housing to the headwear.

In some embodiments, the elongate housing is integrally formed with the headwear. In other embodiments, the elongate housing is mounted to the headwear. In the embodiments wherein the elongate housing is mounted to the headwear, the elongate housing may be detachable from the headwear such that another elongate housing may replace the elongate housing being detached. A lower wall may be provided or not.

The length of the lower edge of the elongate housing may be curved. Preferably, the size and shape of the curve will correspond to the outer surface of the headwear to which the light apparatus is mounted. Advantageously, the elongate member may be mounted flush with the outer surface of the headwear.

The elongate housing may have one or more apertures or ports for accessing at least one electrical component inside the elongate housing. In some embodiments, the elongate housing includes a first aperture or port for allowing access to an on/off switch or mode button for turning on or off the at least one light. In some embodiments, the elongate housing includes a second aperture or port for allowing access to a charging port located inside the elongate housing for charging the at least one battery. In some embodiments, the rear end wall defines the one or more apertures. A person skilled in the art would understand, however, that one or more apertures or ports may be defined by any of the elongate housing walls, for example front end wall, one of the side walls, etc. The apertures or ports may have sealing covers or similar which are removable to access the components and be sealed against debris, detritus or liquids.

In some embodiments, the light apparatus may include a base member for mounting the elongate housing to the headwear. The base member may be elongate and have a substantially constant thickness. The length of the base member may be curved. Preferably, the size and shape of the base member corresponds to the outer surface of the headwear to which the light apparatus is mounted. Advantageously, the base member may be positioned flush with the outer surface of the headwear.

In some embodiments, the base member includes an outwardly extending lip which extends around the perimeter of the base member for engaging with a lip of the elongate member.

The base member may include one or more base member attachment means for attaching the base member to the outer surface of the headwear. In some embodiments, the one or more base member attachment means may be resilient base member attachment means. In some embodiments, the one or more base member attachment means attach to an outside surface of the elongate housing. A skilled person would understand that the base member attachment means may be any suitable attachment means known in the art, for example one or more clips, press fit means, glue, tape, hook and loop fasteners etc.

In some embodiments, each base attachment means may include a free edge. Advantageously, the free edge may be used to deflect each of the base attachment means from an engaged position to a temporary disengaged position to allow removal of the elongate housing from the base member.

In some embodiments, the elongate housing and/or base member may be attachable and/or detachable from the base member. In some embodiments, the elongate housing and/or base member may be permanently attached to the headwear.

In the embodiments wherein the elongate housing is permanently attached to the headwear, the elongate housing may include an opening for removing the at least one battery, and a door or cover for covering the opening.

In some embodiments, the light apparatus may include an intermediate member for at least partially closing an opening defined by the elongate member. Similar to the base member, the intermediate member may be elongate and have a substantially constant thickness. The length of the intermediate member may be curved. Preferably, the size and shape of the intermediate member corresponds to at least a portion of an upper surface of the base member. Advantageously, the intermediate member may be positioned flush with the upper surface of the base member.

In some embodiments, the intermediate member includes an outwardly extending lip which extends around the perimeter of the intermediate member for engaging with a lip of the elongate member.

The intermediate member may include one or more intermediate member attachment means for attaching the intermediate member to the elongate housing. In some embodiments, the one or more intermediate member attachment means may be resilient intermediate member attachment means. In some embodiments, the one or more intermediate member attachment means may attach to an inside surface of the elongate housing. A skilled person would understand that the intermediate member attachment means may be any suitable attachment means known in the art, for example one or more clips, press fit means, glue, tape, hook and loop fasteners etc.

In some embodiments, the elongate housing and/or intermediate member may be attachable and/or detachable from the base member.

The light apparatus may further include one or more electrical components in the form of the at least one light, the at least on battery, an on/off switch or mode button for turning on and off the at least one light, a charging port for charging the at least one battery and/or a printed circuit board (PCB) for mounting the at least one light, at least one battery, on/off switch or mode button and/or charging port relative to the elongate housing. The PCB may be a flexible PCB.

The at least one light may be a LED light or any other light suitable for attaching to a PCB. In some embodiments, the at least one light is coloured blue. However, a skilled person would understand that the at least one light may be any particular colour and/or may change from one colour to another. In embodiments that include more than one light, the lights may be all the same colour or a combination of one or more colours. In some embodiments, the at least one light may have different modes, for example, on, off, flashing, non flashing, pattern of flashing and/or pattern of dimming etc.

In the embodiments that include a single light, the light may be located centrally along the length of the elongate housing. In the embodiments that include more than one light, the lights may be spread a part along the length of the elongate housing. A plurality of lower power light sources such as LED's is preferred spaced over the length of the housing.

In some embodiments, the at least one light may be located towards a front or forward end of the elongate housing. The at least one light may be directed towards an area directly in front of the wearer. Advantageously, the at least one light may be used to illuminate an are directly in front of a wearer.

In some embodiments, as mentioned above, the light apparatus includes at least one battery. In some embodiments, the light apparatus may include two or more batteries. In the embodiments which include two or more embodiments, the batteries may be located in series.

Typically, the at least one battery will be located inside the housing. In some embodiments, however, the at least one battery may be located outside the housing. The at least one battery may be an AAA or AA battery but any type of battery can be used. The at least battery may be a rechargeable battery. The at least one battery may be replaceable.

In embodiments which have one battery, a light may be positioned relative to either end or side of the at least one battery. In embodiments which have two or more batteries, a battery or group of batteries may alternate in series with a light or a group of lights along the length of the elongate housing. However, a skilled person would understand that the order or relative position of the at least one light and/or at least one battery may be any particular combination depending on the shape and size of the housing.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIGS. 7A to 7E show various views of the electrical components of the light apparatus in accordance with the preferred embodiment of the present invention.

DESCRIPTION OF EMBODIMENTS

Figure 1:
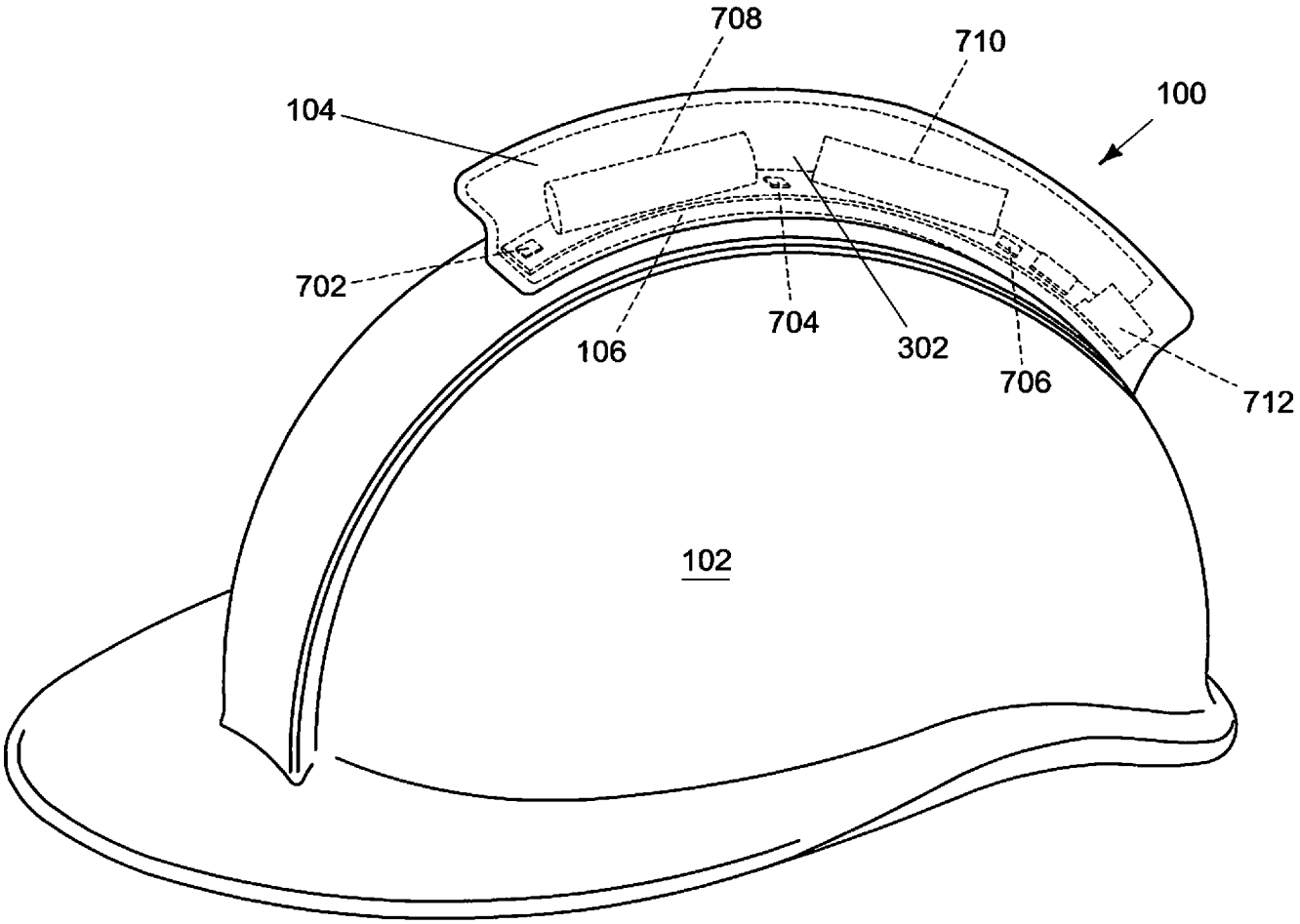
FIG. 1 is a front perspective view of a light apparatus in accordance with a preferred embodiment of the present invention.
Figure 2:
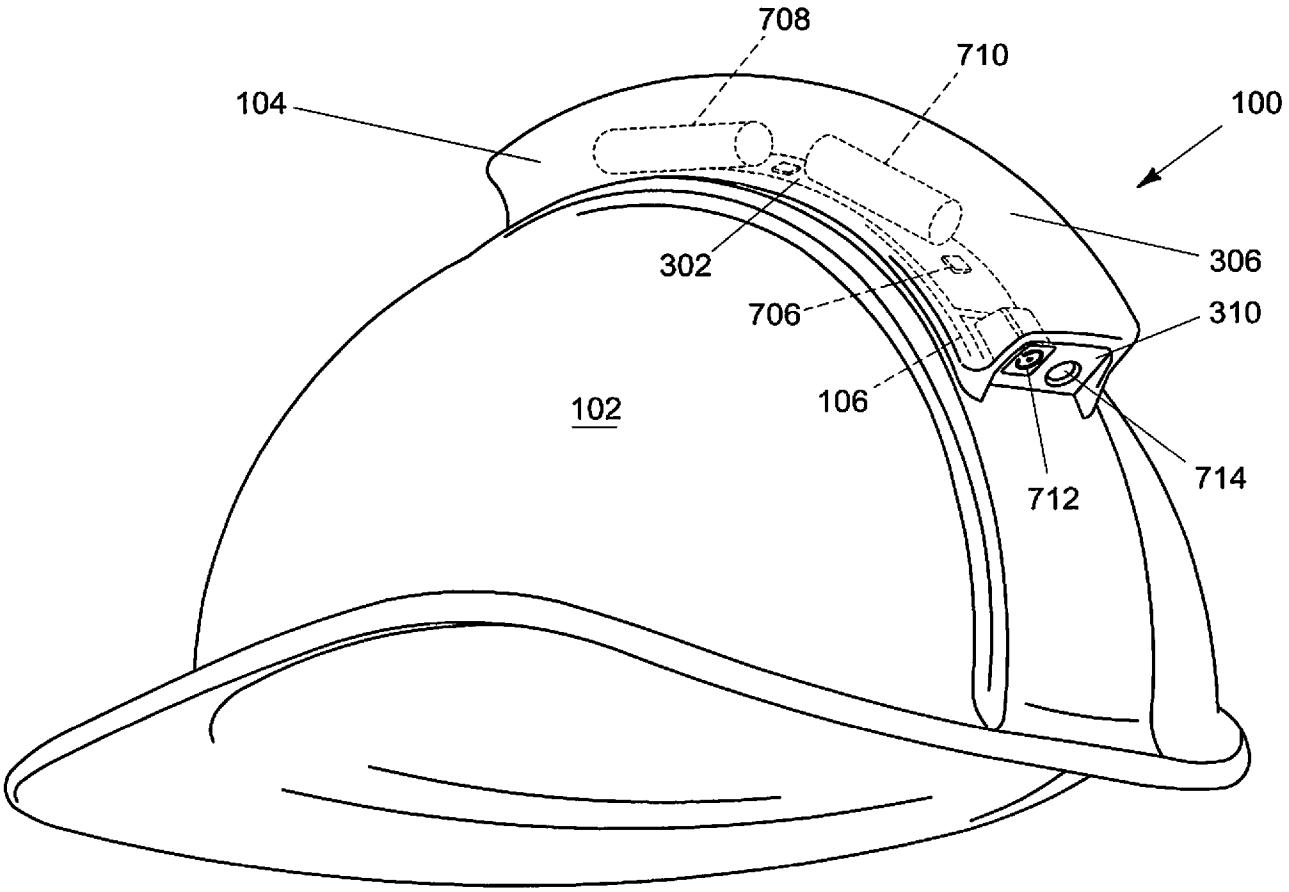
FIG. 2 is a back perspective view of the light apparatus shown in FIG. 1 in accordance with the preferred embodiment of the present invention.
Figure 3:
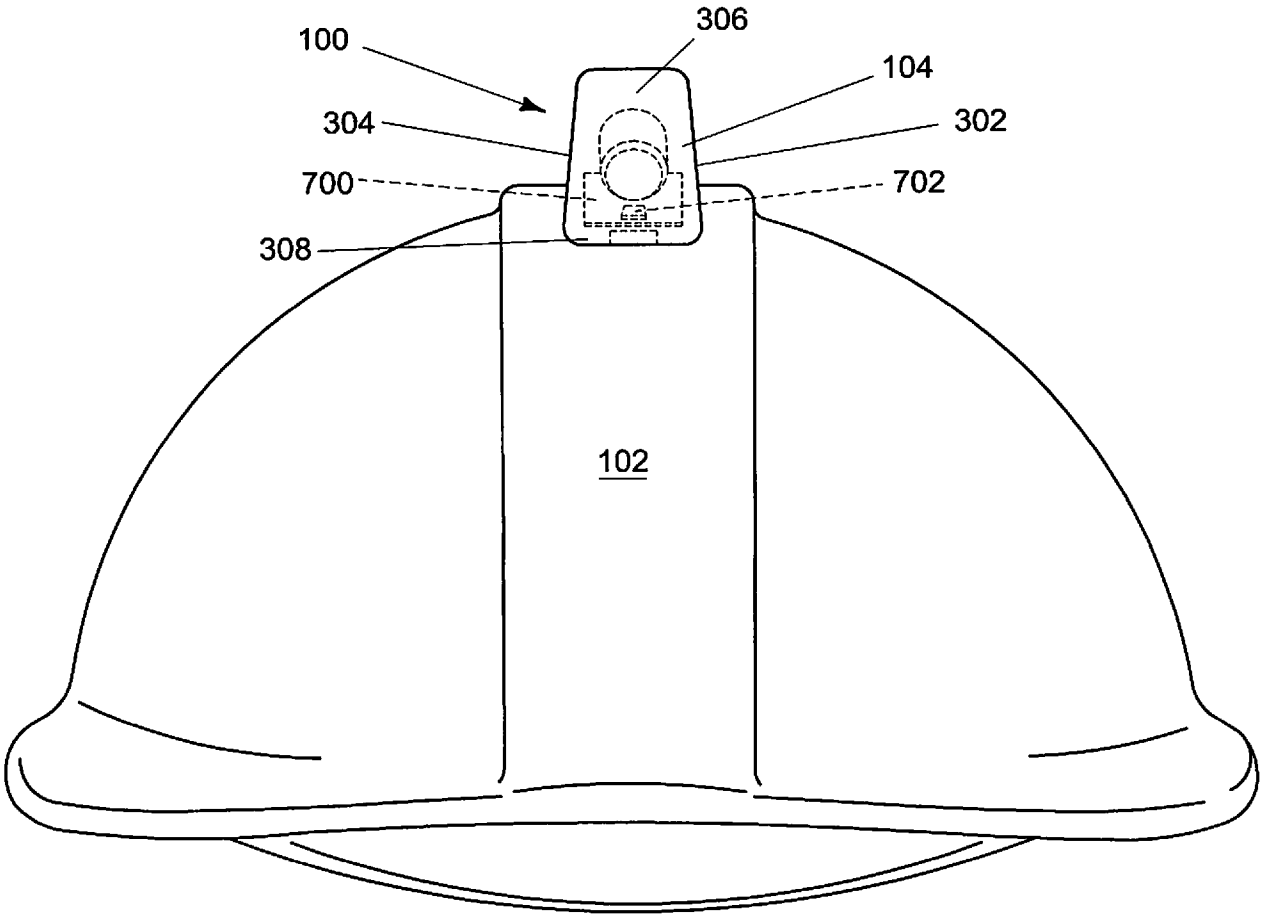
FIG. 3 is a front view of the light apparatus shown in FIG. 1 in accordance with the preferred embodiment of the present invention.
Figure 4:
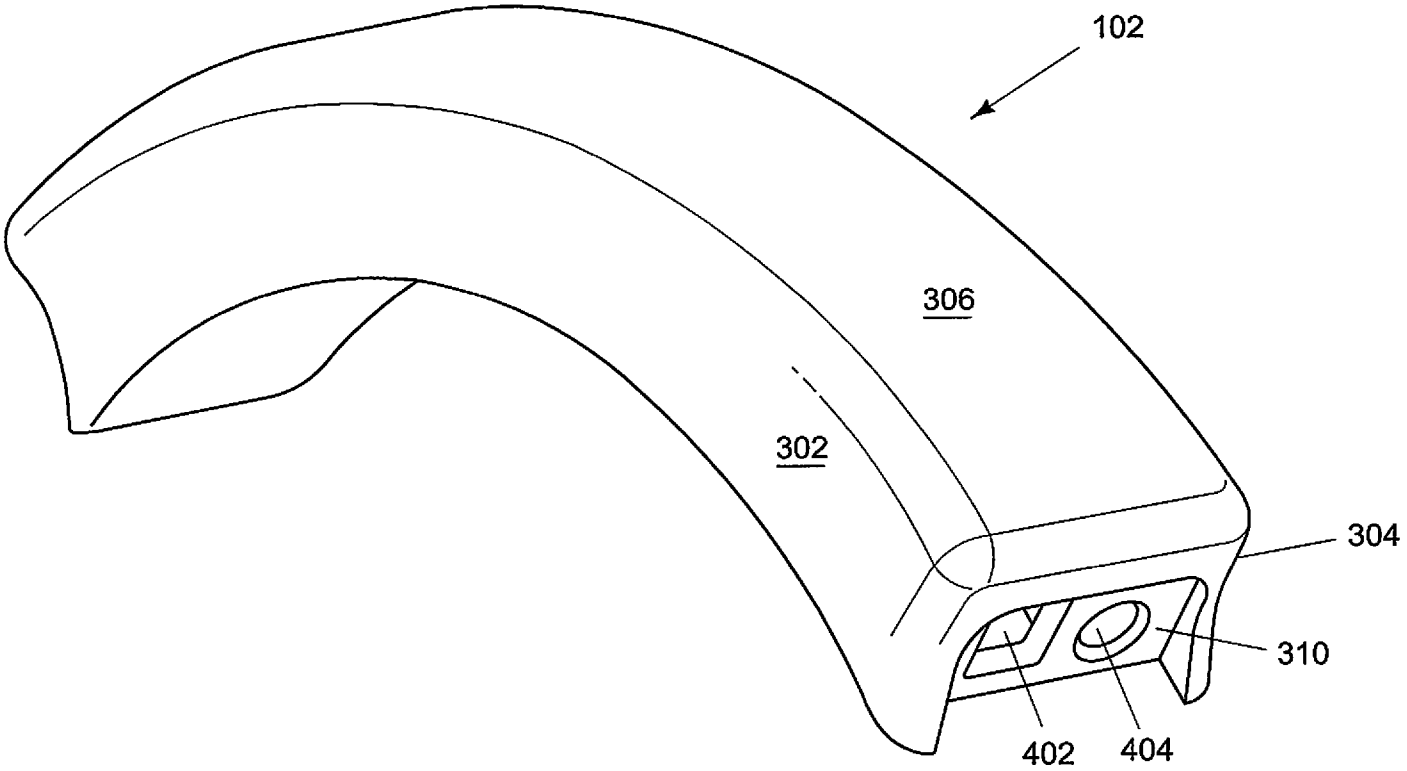
FIG. 4 is a perspective view of the elongate housing in accordance with the preferred embodiment of the present invention

FIGS. 1 to 3 show a light apparatus 100 for headwear 102. In the embodiment shown, headwear 102 is in the form of a hardhat. However, a skilled person would understand that the headwear 102 may be any one of a: safety helmet, Fire Brigade helmet, jockey helmet, bicycle helmet, motorbike, or the alike.

The light apparatus 100 includes a partially hollow, elongate housing 104 and attachment means, in the form of base member 106. Elongate housing 104 is made from a partially transparent or translucent material for allowing light inside the housing to be visible from the outside of the housing.

As can be best seen in FIG. 3, housing 104 has a substantially trapezoidal cross-sectional shape. A skilled person, however, would understand that the cross-sectional area of housing 104 may be any size or shape suitable for housing components within.

Figure 6:
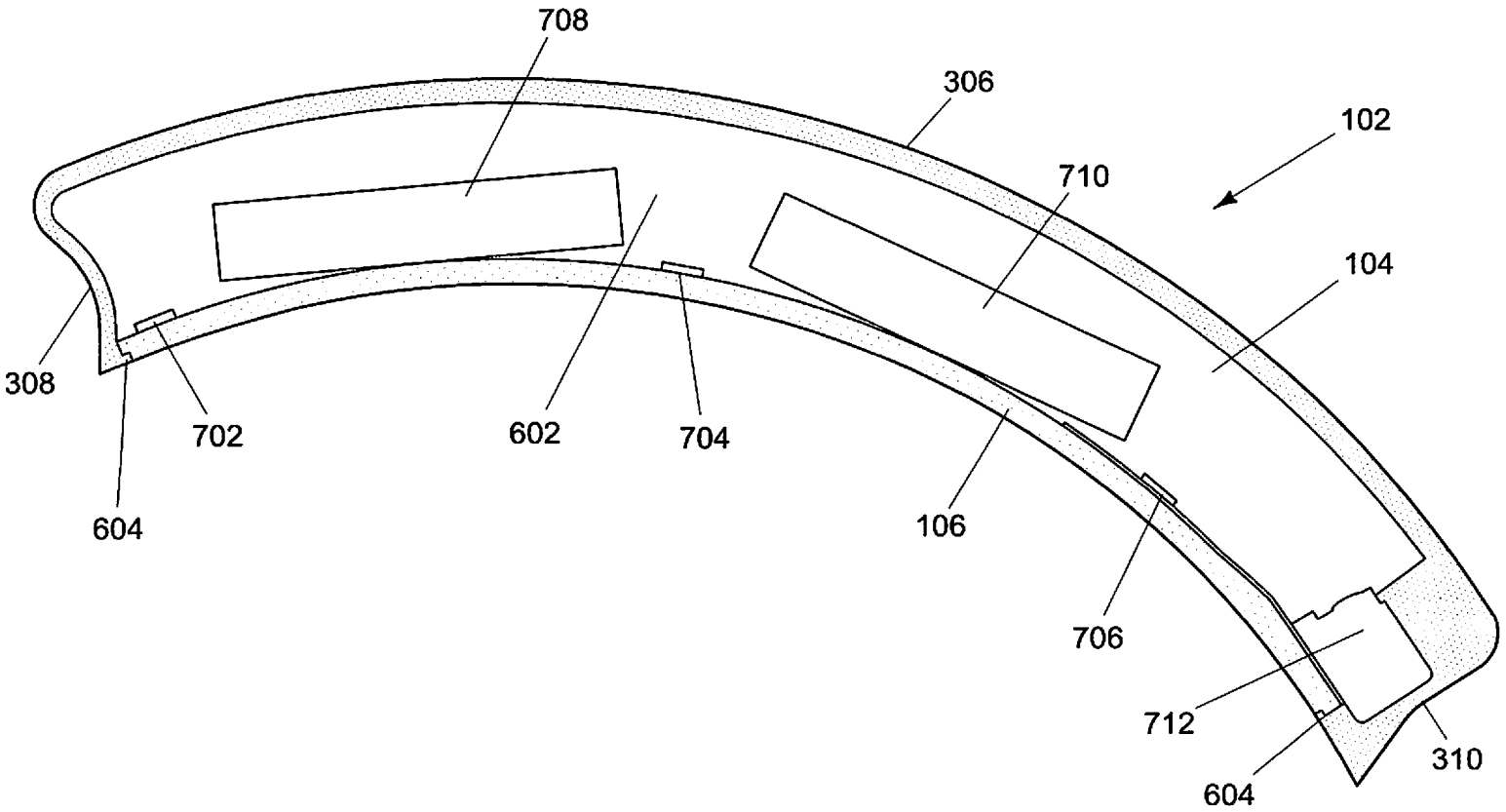
FIG. 6 is a section view of the elongate housing and the base member when assembled in accordance with the preferred embodiment of the present invention.

As can be best seen in FIG. 6, the front end of the elongate housing is shaped differently from one end of the elongate housing such that from the side an observer can determine which way a user is facing. Advantageously, when the light apparatus 100 is mounted to the headwear 102, an orientation of the headwear can be determined. Advantageously, a user wearing the lighting apparatus 100 will be visible from a distance. Further, a third party will preferably be able to establish not only where the wearer is but also the attitude of the wearer. This may be particularly important for notification purposes or to indicate that the wearer has received a notification for example.

Turning back to FIGS. 1-3, elongate housing 104 includes a pair of elongate side walls 302 and 304, and an elongate upper wall 306 for connecting the pair of side walls together. Elongate housing further includes a front wall 308 for capping the front of the housing and a rear wall 310 for capping the rear of the housing 104. Each of the rear wall 310 and front wall 308 extends between an inner surface of side wall 302 and the inner surface of the side wall 304 substantially in a transverse direction to the length of elongate housing 104.

Together the walls 302, 304, 306, 308 and 310 define a cavity 602 for locating various electrical components, including lights 702, 704 and 706 and batteries 708 and 710. Advantageously, the walls 302, 304, 306, 308 and 310 together protect the electrical components located within the housing 104 from debris or detritus which may damage the components and/or prevent light emitted from lights 702, 704 and 706 from being visible from the outside of elongate housing 104.

Walls 302, 304, 308 and 310 define a lower edge of elongate housing 104. The lower edge includes an inwardly extending lip 604 for mounting the elongate housing 104 to base member 106. The length of the lower edge is curved and corresponds to the curve of base member 106 and headwear 102. Advantageously, the elongate housing may be mounted flush with the outer surface of the headwear.

Elongate housing includes an aperture (or port) 404 for accessing an on/off button 714 for turning on and/or off lights 702, 706 and 708. Elongate housing 104 further includes another aperture (or port) 402 for accessing charging port 712 for charging batteries 708 and 710. In the embodiment shown, apertures 402 and 404 are located in rear wall 310. However, a skilled person would understand that in other embodiments the apertures (or ports) may be located in any of walls 302, 304, 306, 308 and 310.

Figure 5:
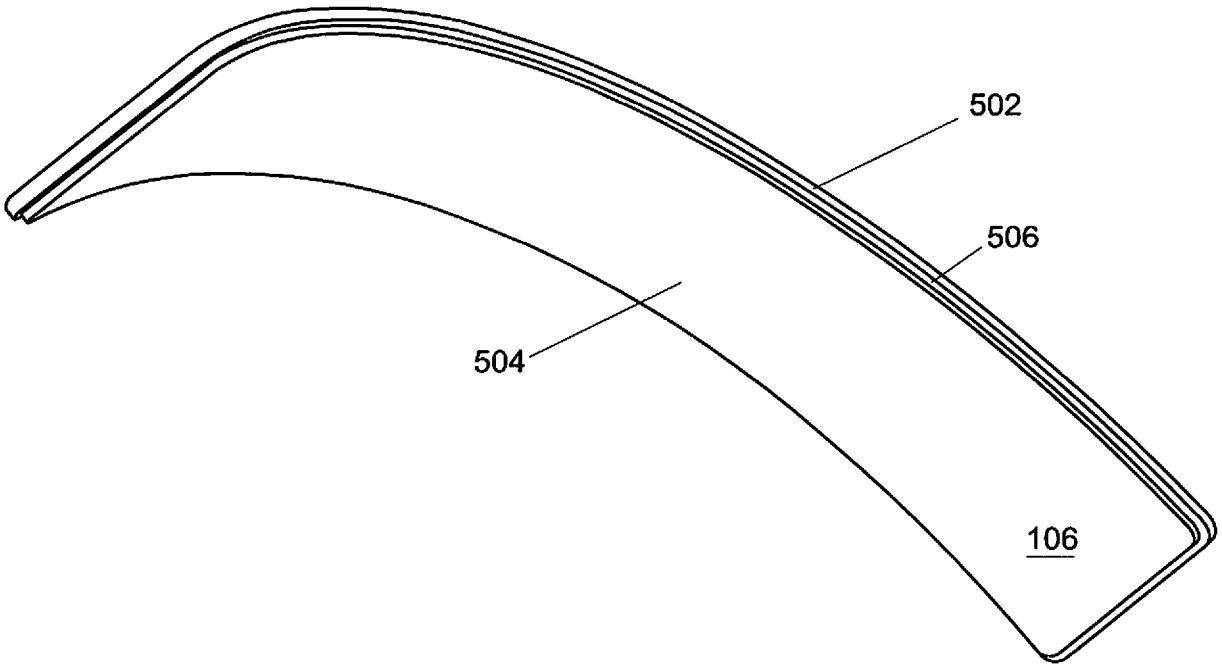
FIG. 5 is a perspective view of the base member in accordance with the preferred embodiment of the present invention.

As mentioned above, light apparatus 100 further includes mounting means, in the form of base member 106 for mounting the elongate housing to the headwear (see FIGS. 5 and 6). The length of base member 106 is curved such that the base member can be mounted flush with the outer surface of headwear 102. The size and/or shape of base member 106 substantially corresponds to the size and shape of the cross sectional area defined substantially by the lower edge or perimeter of elongate housing 306.

Base member 106 further includes an outwardly extending lip 506 for mounting elongate housing 306 thereto by allowing lip 604 of the elongate member to clip in underneath lip 506 of base member 106.

Base member 106 further includes a lower surface 504 for mounting to the outer surface of headwear 102. Lower surface 504 includes one or more attachment means (not shown) for attaching the base member to the outer surface of headwear 102. A skilled person would understand that any suitable attachment means known in the art may be used for attaching the base member to headwear 102, for example one or more clips, hook and loop fasteners, tape, press fit means, or glue.

As best shown in FIGS. 7A to 7E, light apparatus 100 further includes electrical components, in the form of printed circuit board (PCB) 700, lights 702, 704 and 706, batteries 708 and 710, charging port 712 and on/off button 714. The electrical components are located in the hollow portion defined by elongate housing 104. A skilled person would understand that in other embodiments, the number of electrical components may vary, for example, in another embodiment the light apparatus may only include a single battery or more than two batteries and/or include a single light, a pair of lights or more than three lights.

In this embodiment, charging port 712 and on/off button 714 are located towards one end of PCB 700. Further lights 702, 704 and 706, batteries 708 and 710 are aligned in series in an alternating pattern. A skilled person, however, would understand that the components may be located relative to one another in arrangement suitable depending on the size and shape of housing 104.

Another embodiment of the present invention is shown in FIGS. 8-11. As can best be seen in FIG. 11, light apparatus 800 includes an elongate housing 804, a base member 806 and an intermediate member 807 (best shown in FIG. 11). Elongate housing 804 includes substantially all of the features as substantially described above in relation to the embodiment shown in FIGS. 1-7. In addition, elongate housing includes a number of outer recesses 1101 and a number of inner recesses (not shown).

Figure 10:
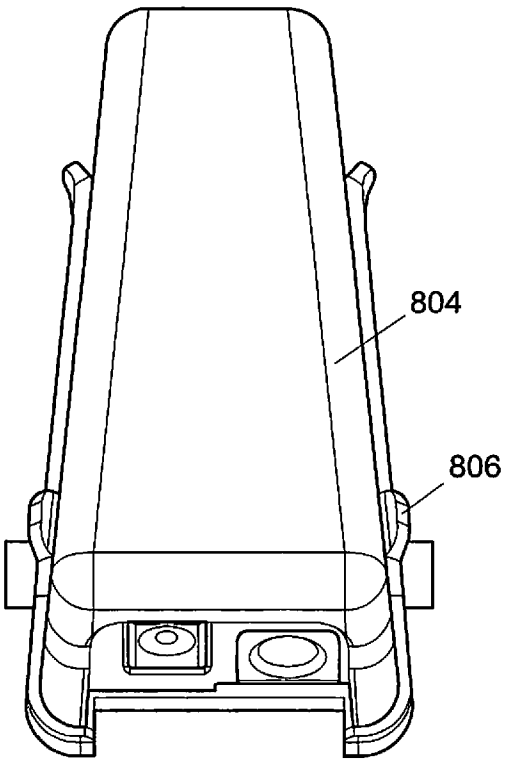
FIG. 10 is back perspective view of the light apparatus as shown in FIGS. 8 and 9.
Figure 9:
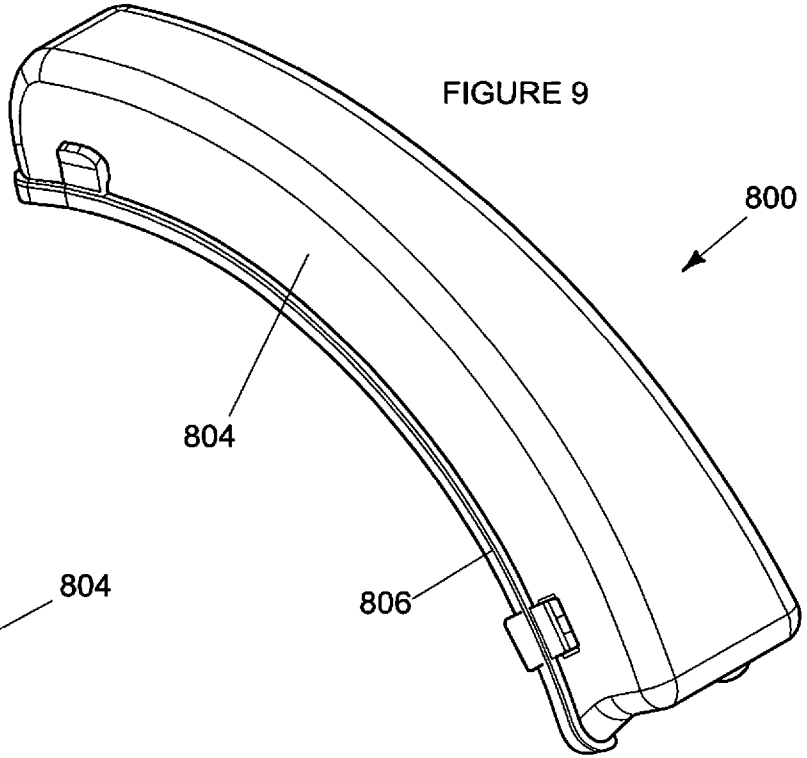
FIG. 9 is an isometric view of the light apparatus as shown in FIG. 8.
Figure 8:
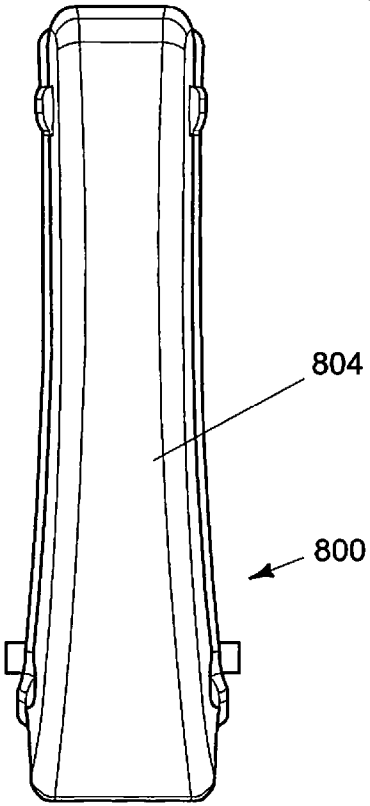
FIG. 8 is a top perspective view of a light apparatus in accordance with another preferred embodiment of the present invention.

Base member 806 includes also substantially all of the features as substantially described above in relation to the embodiment shown in FIGS. 1-7. Base member 806, however, includes a lip 1100 locating elongate housing 804 relative thereto. Base member 806 further includes base attachment means in the form of clips 1102*a*, 1102*b*, 1102*c* and 1102*d* for engaging outer recesses 1101. Clips 1102*a*, 1102*b*, 1102*c* and 1102*d* each include a free end including a free edge 1104*a*, 1104*b*, 1104*c*, 1104*d* that is spaced apart from the outer surface of elongate housing 804. Advantageously, the free end of each clip 1102*a*, 1102*b*, 1102*c* and 1102*d* may be deflected away from outer surface of the elongate housing from an engaged position (as best shown in FIGS. 8-10) to a temporary disengaged position to allow removal of the elongate housing and intermediate member 807 from the base member.

In some embodiments, the light apparatus may include an intermediate member for at least partially closing an opening in the elongate member. Similar to the base member, the intermediate member may be elongate and have a substantially constant thickness. The length of the intermediate member may be curved. Preferably, the size and shape of the base member corresponds to at least a portion of an upper surface of the base member. Advantageously, the intermediate member may be positioned flush with the upper surface of the base member.

Figure 11:
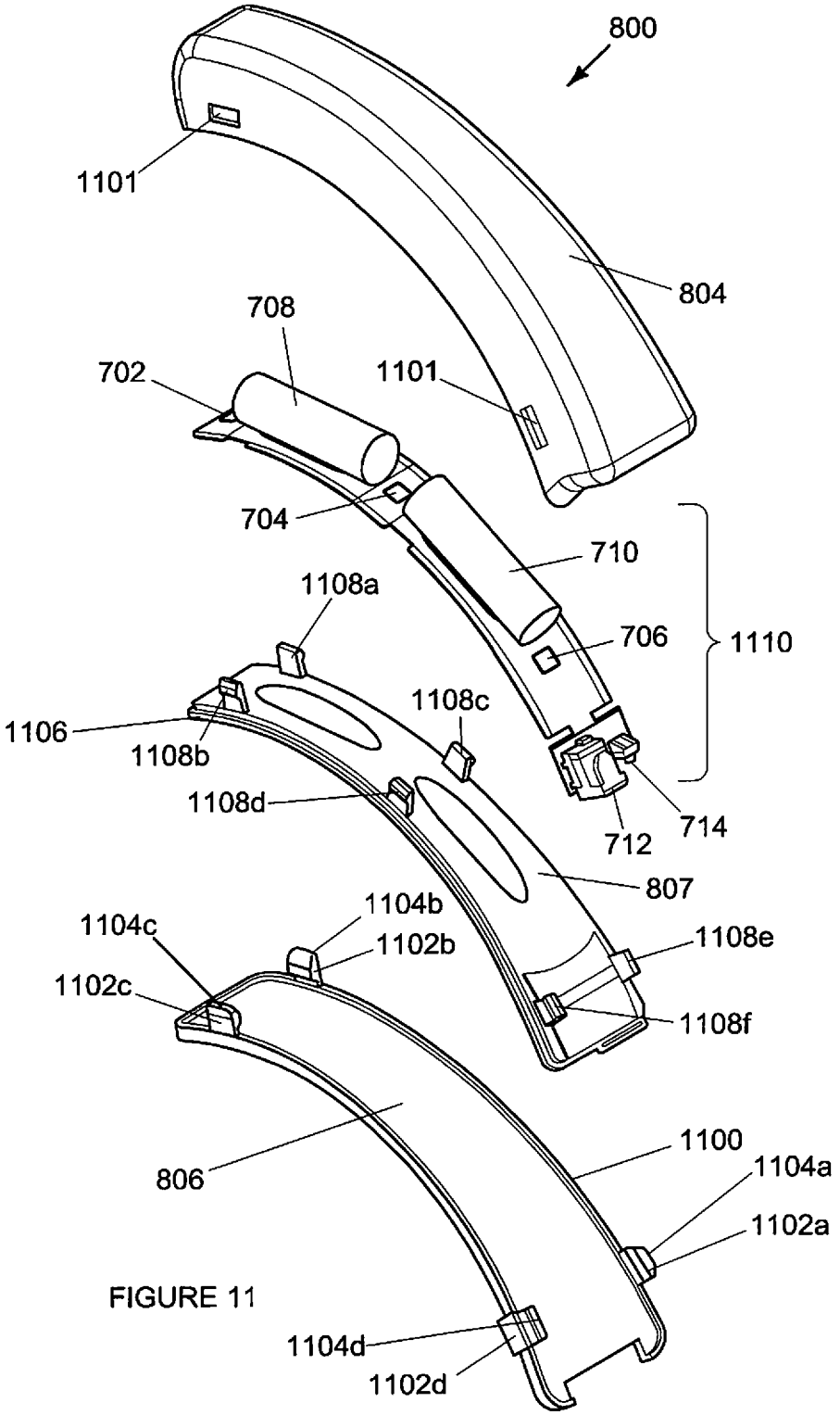
FIG. 11 is an exploded view of the light apparatus as shown in FIGS. 8 to 10.

Intermediate member 807 is best shown in FIG. 11 and includes an outwardly extending lip 1106 which extends around the perimeter of the intermediate member for engaging with the lip of the elongate member.

Intermediate member 807 includes intermediate member attachment means, in the form of resilient clips 1108*a*, 1108*b*, 1108*c*, 1108*d*, 1108*c*, 1108*e*, 1108*f*, for attaching intermediate member 807 to elongate housing 804. Clips 1108*a*, 1108*b*, 1108*c*, 1108*d*, 1108*c*, 1108*e*, 1108*f* attach to an inside surface of elongate housing 804. Advantageously, elongate housing 804 and intermediate member 807 form an enclosure for housing electrical components 1110.

Light apparatus 800 includes further includes electrical components 1110. Electrical components 1110 include substantially all of the features as substantially described above in relation to the embodiment shown in FIGS. 1-7.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A light apparatus for headwear comprising:

an at least partially hollow, elongate housing for mounting to the headwear, the elongate housing being mounted in a front to back configuration, at least one light located inside the elongate housing that is visible from the outside of the elongate housing, a base member or an intermediate member or both that are connected to the elongate housing and that at least partially enclose the at least one light inside the elongate housing wherein the base member comprises at least one mounting arrangement for mounting the elongate housing to the base member, the intermediate member to the elongate housing, the intermediate member to the base member, or the base member to the headwear, and at least one battery for powering the at least one light, such that when the light apparatus is mounted to the headwear, an orientation of the headwear can be determined.

2. The light apparatus of claim 1, wherein the elongate housing is made from a transparent or translucent or at least partially transparent or translucent material.

3. The light apparatus of claim 1, wherein the elongate housing has a substantially rectangular or trapezoidal cross sectional shape.

4. The light apparatus of claim 1, wherein the elongate housing comprises a front end and a rear end and the shape of the forward end is different from the shape of the rear end.

5. The light apparatus of claim 1, wherein the elongate housing comprises a pair of side walls, rear wall and a front wall that define a lower edge of the elongate member.

6. The light apparatus of claim 5, wherein the length of the lower edge is curved.

7. The light apparatus of claim 5, wherein the lower edge comprises an inwardly extending lip for mounting the elongate member to the headwear.

8. The light apparatus of claim 7, further comprising an upper wall and wherein the pair of side walls, upper wall, rear wall and front wall define a cavity for locating one or more electrical components.

9. The light apparatus of claim 8, wherein the elongate housing comprises at least one aperture or port for accessing the at least one or more electrical components located inside the elongate housing.

10. The light apparatus of claim 8, wherein the one or more electrical components comprise any one or more of a printed circuit board (PCB), the at least one light, the at least one battery, an on/off switch or mode button or charging port.

11. The light apparatus of claim 8, wherein the at least one or more electrical components comprise three lights and two batteries arranged alternating and in series along a length of the PCB.

12. The light apparatus as claimed in claim 11, wherein the electrical components comprise the on/off switch or mode button and the charging port which are mounted to one end of the PCB.

13. The light apparatus of claim 1, wherein the length of the base member or the intermediate member or both is curved.

14. The light apparatus of claim 1, wherein at least one of the base member or the intermediate member comprises an outwardly extending lip.

15. The light apparatus of claim 1, wherein the at least one light has multiple modes, including two or more of: on, off, flashing, alternating, pattern of flashing, or pattern of dimming.

16. The light apparatus of claim 1, wherein the at least one light is operable to change colour.

17. The light apparatus of claim 1, wherein the elongate housing is replaceable or interchangeable.

* * * * *